US005112537A

United States Patent [19]

Kinney, Jr.

[11] Patent Number: 5,112,537

[45] Date of Patent: May 12, 1992

[54] PERFORATED ARCH-SHAPED FILL BAR FOR SPLASH TYPE WATER COOLING TOWER

[75] Inventor: Ohler L. Kinney, Jr., Leawood, Kans.

[73] Assignee: The Marley Cooling Tower Company, Mission, Kans.

[21] Appl. No.: 691,135

[22] Filed: Apr. 25, 1991

[51] Int. Cl.[5] ..... B01F 3/04

[52] U.S. Cl. ..... 261/111; 261/DIG. 11

[58] Field of Search ..... 261/111

[56] References Cited

U.S. PATENT DOCUMENTS

| | | | |
|---|---|---|---|
| 3,389,895 | 6/1968 | De Flon | 261/111 |
| 3,468,521 | 9/1969 | Furlong et al. | 261/111 |
| 3,799,516 | 3/1974 | Furlong et al. | 261/111 |
| 4,663,092 | 5/1987 | Kinney, Jr. et al. | 261/111 |
| 4,868,956 | 9/1989 | Shepherd | 261/111 |
| 4,915,877 | 4/1990 | Shepherd | 261/111 |

*Primary Examiner*—Tim Miles

*Attorney, Agent, or Firm*—Hovey, Williams, Timmons & Collins

[57] ABSTRACT

Improved synthetic resin splash-type fill bar (32) for water cooling tower fill assemblies (26, 28) are provided which give enhanced cooling results over virtually the entire range of duty conditions encountered in commercial practice. The bars (32) are preferably integrally formed of PVC and present a dome-like cross-sectional configuration, with an imperforate, fore and aft extending upper apex section (36) and downwardly and outwardly diverging, apertured sidewalls (38, 40) terminating in bifurcated feet (42, 44). The sidewall apertures (50) are nominally circular and are arranged in staggered rows to maximize dispersal of descending hot water in a tower fill. The bars (32) are advantageously used in crossflow cooling tower (10), and are preferably oriented transverse to incoming cooling air currents entering the fill assemblies (26, 28) of the tower (10).

10 Claims, 6 Drawing Sheets

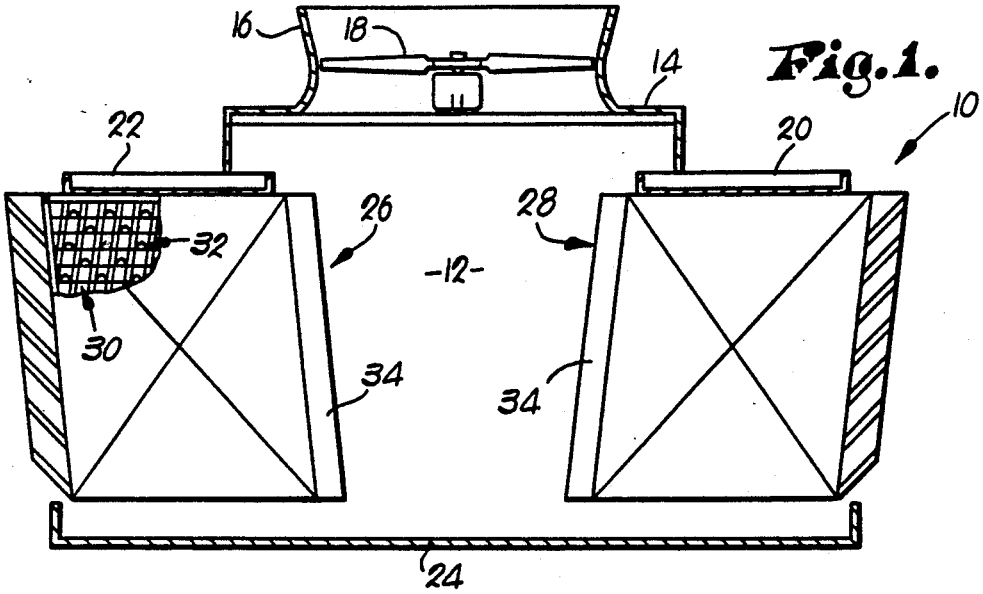
Fig. 1.
Fig. 3.
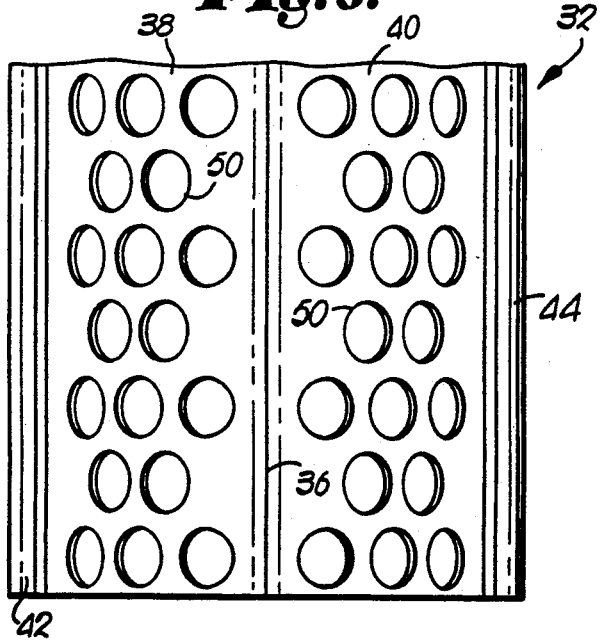
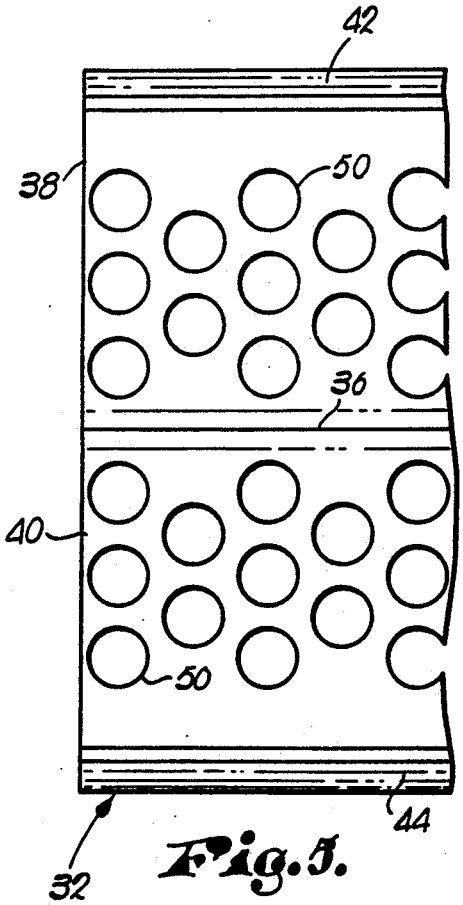
Fig. 5.
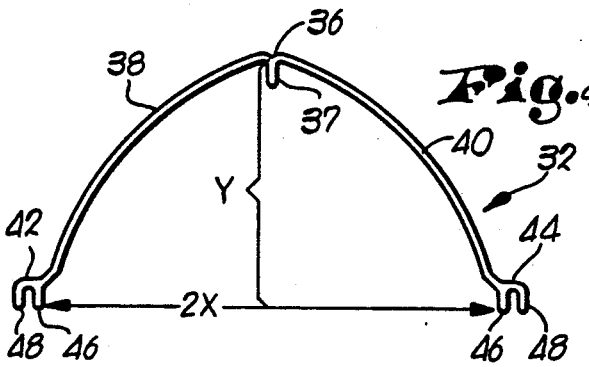
Fig. 4.

PERFORATED ARCH-SHAPED FILL BAR FOR SPLASH TYPE WATER COOLING TOWER

BACKGROUND OF THE INVENTION

1. Field of the Invention

The present invention is broadly concerned with preformed synthetic resin splash bars of the type used as fill members in evaporative water cooling towers. More particularly, it is concerned with fill splash bars which are especially configured for a low cost construction while giving improved tower performance in use; in this regard, the splash bars of the invention are characterized by a dome-like shape presenting an uppermost, fore and aft extending apex section together with a pair of downwardly and outwardly diverging, apertured sidewalls each presenting, at the lowermost end thereof, a support for the body. Very importantly, the vertical height of the body, when resting on the spaced apart feet thereof, is greater than one-half of the lateral distance between the feet. Comparative testing using the splash bars of the present invention versus conventional prior bars demonstrates that improved tower performance results, while at the same time lowering the cost of the fill.

2. Description of the Prior Art

In general, evaporative water cooling towers include upper hot water distribution systems such as an apertured distribution basin or the like, with an underlying lowermost cold water collection basin. Commonly, a splash type water dispersing fill structure is disposed between the distribution system and cold water collection basin. Such fill structure typically includes a plurality of elongated, horizontally arranged splash bars supported at spaced intervals by an upright grid structure. In use, hot water delivered to the distribution system falls by gravity through the fill structure, where it is advantageously dispersed into droplet form. At the same time, cooling air currents are drawn through the fill structure, either by means of a motor driven fan or through use of the natural draft-inducing hyperbolic tower.

The fill structure is generally regarded as the single most important component of the cooling tower, because the fill promotes interactive thermal energy exchange between initially hot water and cooling air currents. As water droplets are formed in the fill region, the temperature difference between relatively warm water and the cooling air causes evaporation on the surface of the drops and cooling of the water occurs therefore at a rapid rate. However, as the surface temperatures of individual water droplets approach the wet bulb temperature of the surrounding air, the cooling process is diminished and is dependent upon the rate of heat transfer on the inside of the drop to the outside of the drop surface. As such, it is desirable to interrupt the fall of individual drops by splashing the drops on a fill bar, thus instantly exposing new water surfaces and, in some cases, subdividing drops into smaller droplets to increase the total water surface area available for exposure to the passing air.

As can be appreciated, the characteristics of any fill structure splash bar must meet several criteria to assure satisfactory operation and performance. First, the splash bar should provide consistent, predictable dispersal and breakup water droplets over a range of water loadings typically encountered in practice. Preferably, the descending droplets are uniformly broken into relatively fine droplet particles in a widely divergent pattern to facilitate enhancement of the cooling process. In this regard, while water droplet formation is essential to effective cooling, care must be taken to insure that this phenomenon does not occur to a point where a fine mist is formed; such mists can become entrained in the cooling air currents, and are thereby discharged to the surrounding atmosphere unless special steps are taken to insure mist removal. Thus, an important goal of a splash bar designer is to insure that the bars give adequate droplet formation, while not giving rise to the formation of mists.

Furthermore, splash bar structure should cause a minimum amount of air pressure drop in order to keep fan horsepower requirements as well as operating costs at relatively low levels. In this respect, the goal of uniform droplet formation can be seen as somewhat at odds with the requirement of minimizing pressure droplets across a given fill structure.

In addition, splash bars should have sufficient structural strength to span the distance between adjacent upright supporting grids, since deflection of the bars can cause water to be channeled toward the low part of the bar, thereby causing unequal water dispersal throughout the passing air stream and the formation of undesirable coalesced streams of water. This problem with bar deflection is of course more common when the bars are formed of synthetic resin material, since such bars often lose strength and stiffness when subjected to the elevated temperatures of the hot water to be cooled. Another important consideration is that of the cost of the fill bars. For example, a large hyperbolic induced-draft tower may utilize something on the order of 2,000,000 splash bars, each four feet in length. As a result, the use of bars formed of expensive metallic materials cannot usually be economically justified, even though metallic bars may provide very adequate cooling performance.

Other factors which enter into splash bar design include the ability to deal with contaminated organisms (which can clog splash bar openings), dirty incoming air, and ice buildup which may occur during down time in cold water locales.

In the past, splash bars have often been comprised of elongated, rectangular in cross-section bars of such wood species as redwood or treated Douglas fir. However, wood splash bars even normally rot resistant, can deteriorate due to chemicals in the water streams. Also, wood bars present serious fire hazards as soon as water flow is interrupted and the moisture remaining on the bars has evaporated.

It has also been known in the past to make use of a variety of splash bar configurations, wherein the bars are formed of synthetic resin material such as polyvinylchloride (PVC). For example, U.S. Pat. No. 3,389,895 to DeFlon describes a number of splash bar configurations, including an inverted V-shaped bar, a generally crescent-shaped bar, and sheet material with transverse corrugations. Also, it is known that certain splash bars are made up of tubular, hollow extrusions of PVC, wherein the top water-engaging surfaces is generally transversely semicircular and a bottom portion is deformed upwardly to present a pair of spaced apart lower surfaces.

U.S. Pat. No. 4,663,092 describes another type of extruded synthetic resin splash bar. The bar described in this patent includes a pair of arcuate in cross-section side margins, and an elongated, horizontal, flat top segment interconnecting the side margins. The centers of curvature of the side margins of this bar are coincident and lie beneath the body. In overall configuration, this splash bar is relatively flat, with the height thereof being substantially less than one-half the effective width of the bar.

SUMMARY OF THE INVENTION

The present invention relates to a new fill bar design which meets essentially all of the requirements of an optimum bar. That is to say, the splash bar of the invention is low in cost, yet gives increased tower performance without undue pressure drop across the tower fill section. Moreover, the unique design of the fill bar is resistant to contamination by water-borne microorganisms, and can accommodate dirty water and ice-buildup without fill damage.

Broadly speaking, the fill bar of the invention is in the form of an elongated preformed body, preferably composed of a synthetic resin material such as polyvinylchloride, which presents an uppermost, fore and aft extending apex section and a pair of downwardly and outwardly diverging sidewalls extending from the side margins of the apex section. The sidewalls define, at the lowermost ends thereof, a pair of elongated, laterally spaced apart feet for supporting the body during use thereof. Very importantly, each of the sidewalls is arcuate in cross-section and has a series of apertures therethrough. Moreover, the vertical height of the body, when resting on the feet thereof, is greater than one-half of the lateral distance between such feet. In this fashion, the bar has adequate height to insure full intersecting relationship with cooling air currents.

In particularly preferred forms, the fore and aft extending apex section is imperforate and presents an effective droplet-dispersing top; in addition, the apex section advantageously includes an elongated, downwardly extending, short central rib located between the sidewalls. This rib not only rigidifies the body and inhibits sagging thereof during use, but also facilitates nesting of the fill bars during storage and shipping.

The arcuate sidewall sections are advantageously essentially mirror images of each other, and in practice define a sector of an imaginary circle, with the centers of the imaginary circles being laterally spaced from one another.

In actual practice, the fill bars of the invention are provided with generally circular openings through the respective sidewalls thereof, although other shapes of openings are possibilities. The sidewall apertures are moreover in a staggered configuration, i.e., adjacent apertures along the length of the sidewalls are vertically spaced from each other. In order to insure adequate drop formation and tower performance, the apertures are sized and located to give the body from about 20–40% net opening area therethrough, most preferably about 30% net opening area.

BRIEF DESCRIPTION OF THE DRAWINGS

FIG. 1 is a schematic vertical sectional view, with parts broken away for clarity illustrating a typical mechanical-draft crossflow cooling tower having the fill bars of the present invention situated within respective, opposed fill regions therein;

FIG. 3 is the fragmentary plan view of the preferred fill bar in accordance with the present invention;

FIG. 4 is an end elevational view of the preferred fill bar;

FIG. 5 is a fragmentary plan view of the flattened fill blank after preliminary thermal forming and punching thereof, but prior to formation of the blank into the dome-like configuration of the final splash bar;

DETAILED DESCRIPTION OF THE PREFERRED EMBODIMENTS

Figure 2:
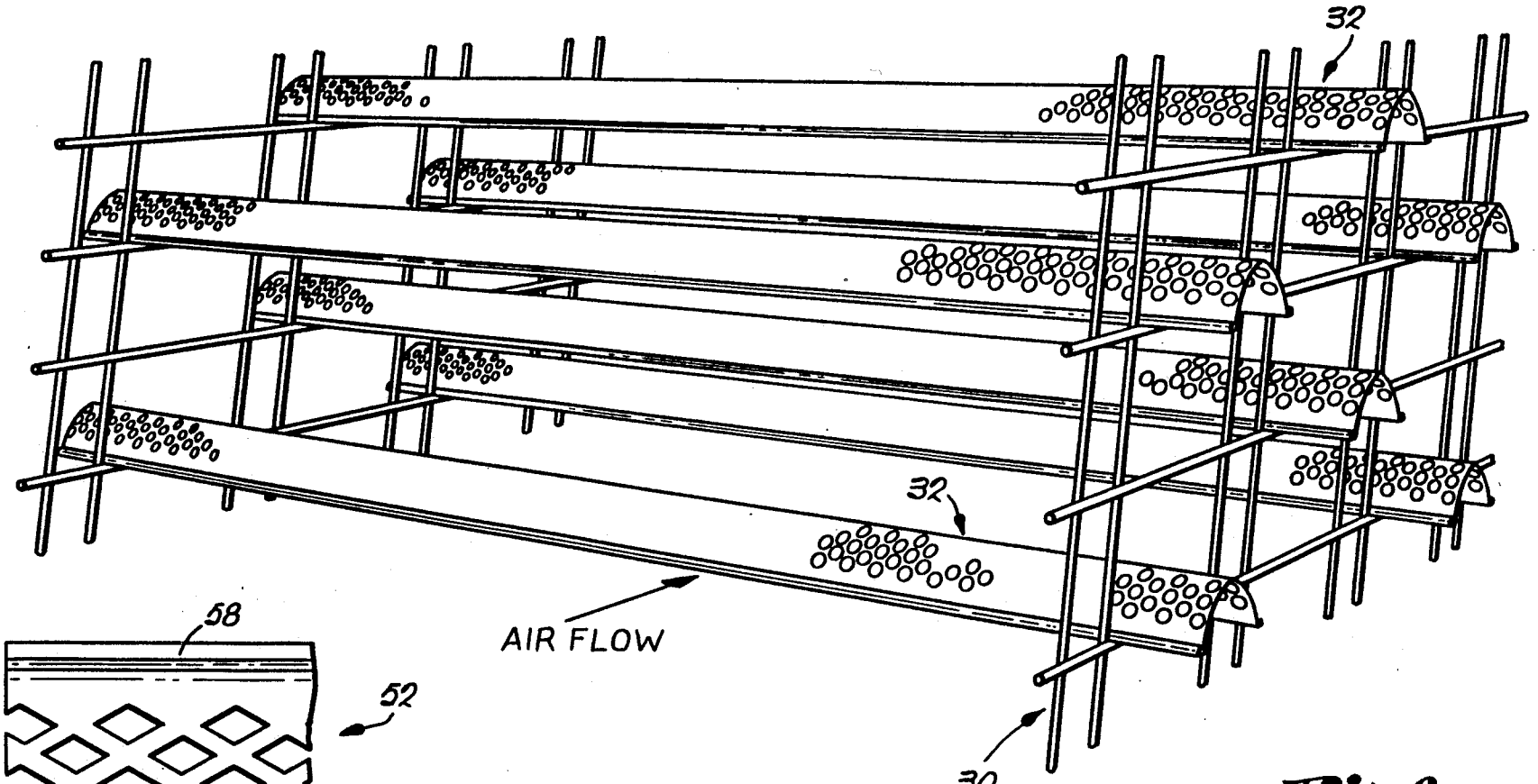
FIG. 2 is a perspective view illustrating a portion of a fill assembly with the splash bars of the present invention, in the context of a crossflow cooling tower.

Turning now to the drawings, and particularly FIG. 1, a mechanical draft crossflow cooling tower 10 is schematically illustrated. The tower 10 includes an upright central plenum 12 surmounted by an apertured top wall 14, the latter being equipped with a venturi-type fan stack 16. A mechanically powered fan 18 is situated within stack 16, in the conventional manner. The overall tower 10 further includes a pair of laterally spaced apart hot water distribution basins 20, 22 for receiving hot water to be cooled and distributing the same via an apertured bottom wall forming a part of each basin. A common underlying cold water collection basin 24 is positioned beneath the basins 20, 22 and plenum 12. A pair of fill assemblies, broadly referred to by the numerals 26 and 28, are situated in spaced, opposed relationship beneath a corresponding distribution basin 20 or 22 in communication with plenum 12. Each of the fill assemblies 26, 28 is essentially identical, and includes an upright grid assembly 30 which support a plurality of elongated splash bars 32 serving to break up hot water descending from the overlying basin. The respective fill assemblies may also include a conventional, inboard drift eliminator 34 which serves to remove entrained water from the air currents leaving the fill sections.

As those skilled in the art will appreciate, in the use of tower 10 hot water is initially delivered to the basins 20, 22 whereupon it descends under the influence of gravity into and through the fill assemblies 26, 28. In the fill assemblies, water encounters the splash bars 32, which serves to break up the water into small droplets. Simultaneously, operation of fan 18 serves to draw incoming, crossflowing air currents through the outboard faces of the respective fill assemblies, so that such air comes into intersecting, thermal interchange relationship with the descending droplets. Such air currents pass through each of the fills 26, 28 and the inboard drift eliminators 34, whereupon they are commingled in plenum 12 and are exhausted to the atmosphere through stack 16. The cooled water gravitating from the respective fill assemblies is then collected in basin 24 for reuse.

Although the splash bars of the present invention find particular utility in crossflow cooling towers, the invention is not so limited. Specifically, bars in accordance with the invention may be used in counterflow towers if desired. Moreover, because of the lost cost and ease of manufacture characteristic of the splash bars of the invention, they are eminently suited for tower reconstruction projects wherein existing towers are refitted with new fill assembly components.

Attention is next directed to FIG. 2 which illustrates in more detail the use of splash bars 32 in accordance with the invention, in the context of a crossflow tower fill. It will be observed that the bars 32 are oriented transversely relative to the incoming cooling air currents (labeled "AIR FLOW" in FIG. 2), and are supported adjacent their ends by the upright grid assembly 30. The splash bar orientation depicted in FIG. 2 is preferred; however, if desired, the bars of the present invention can be used in contexts where they are oriented parallel to air flow, i.e., the longitudinal axes of the splash bars are parallel with the direction of travel of incoming cooling air currents.

FIGS. 3–4 illustrate in detail the construction of the preferred splash bars 32. Specifically, it will be seen that the splash bar 32 is essentially dome-shaped in configuration and presents an elongated, fore and aft extending apex section 36 having a short, depending, stacking and strengthening rib 37, with a pair of downwardly and outwardly diverging, arcuate in cross-section sidewalls 38, 40 extending from the side margins of the apex section 36. Each of the sidewalls 38, 40 terminates in a lowermost, bifurcated foot 42 or 44, with each foot being composed of an inboard, short depending wall 46 as well as a slightly spaced apart, opposed outboard wall 48. Again viewing FIG. 4, it will be observed that the inboard walls 46 and outboard walls 48 are spaced slightly outwardly relative to the associated sidewalls, through a short, transition section.

In preferred forms, the fill bars of the invention are constructed to present a vertical height, when resting on the feet 42, 44, somewhat greater than one-half the lateral distance between the adjacent inner surfaces of these feet. This situation has been specifically depicted in FIG. 4 by virtue of the distances "2X" and "Y". Thus, the vertical dimension "Y" is greater than one-half the dimension "2X".

It will also be seen that the sidewalls 38, 40 are provided with a series of apertures 50 therethrough. During the initial fabrication of the bars 32, they are first formed as flat blanks (see FIG. 5), and in this orientation the apertures 50 are truly circular. In the final phase of construction, the initially formed, flat blank is shaped to present the dome-like configuration illustrated in FIGS. 3 and 4, and in such orientation, the apertures 50 assume a slightly oval shape. In addition, it will be observed that the lowermost regions of the respective sidewalls 38, 40 are essentially imperforate, with the apertures 50 being located more towards the middle and upper parts of the respective sidewalls. In any event, the apertures 50 are sized and arranged so that the net free open area of each sidewall 38, 40, normal to each side thereof, is approximately 29%, whereas the net free open area at a projected horizontal plane above the fill bar is approximately 23%. This is to be contrasted with the open areas of triangular shaped fill bars having continuous diamond-shaped openings as depicted in FIGS. 3–4 of U.S. Pat. No. 3,389,895, namely 49% and 37% respectively. Thus, the bars of the present invention have significantly less net open area than the prior comparative bars.

In preferred forms, the splash bars 32 of the invention are formed using conventional polyvinylchloride synthetic resin material, having a nominal thickness of about 0.05". Of course, other suitable materials could also be used, but for reasons of costs and ease of manufacture, the synthetic resins are preferred.

Figure 10:
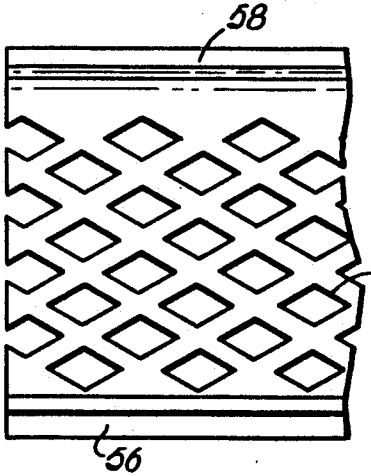
Fig.10. PRIOR ART
FIG. 10 is a view taken along the line 10—10 of FIG. 9, and illustrating in detail the construction of the prior art splash bar.
Figure 8:
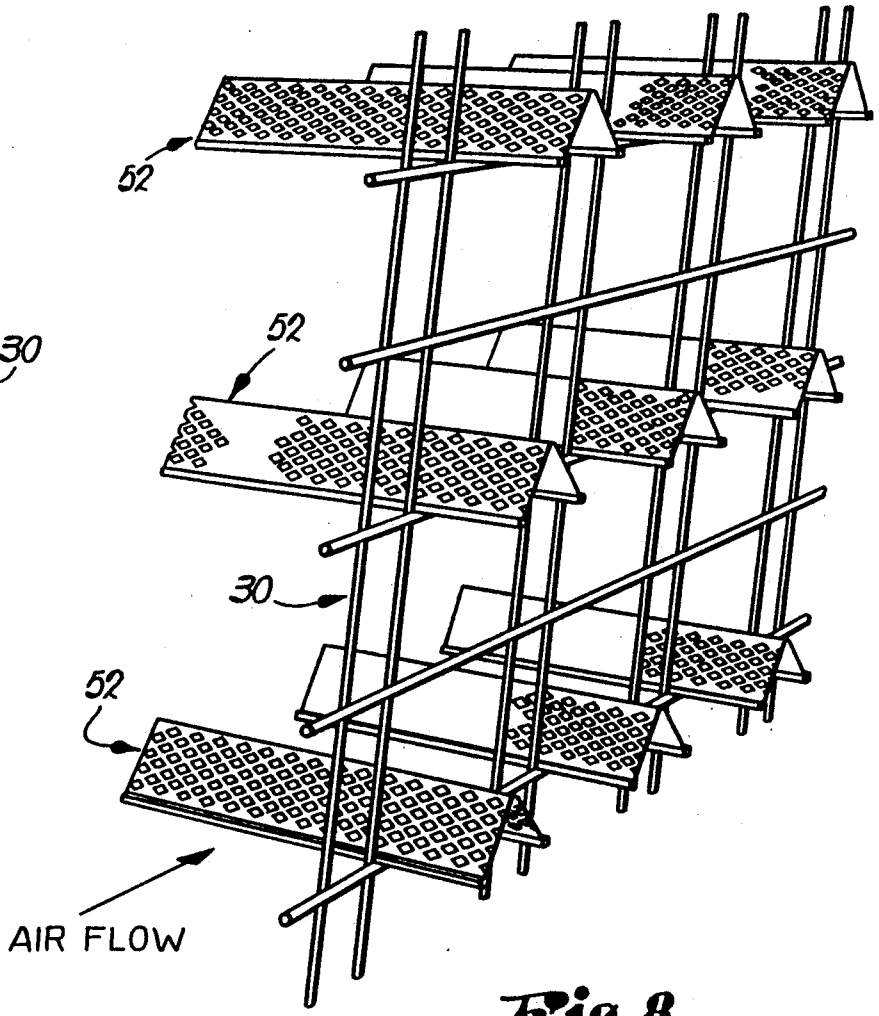
Fig. 8. PRIOR ART
FIG. 8 is a perspective view of a fill structure employing conventional inverted V-type splash bars.
Figure 9:
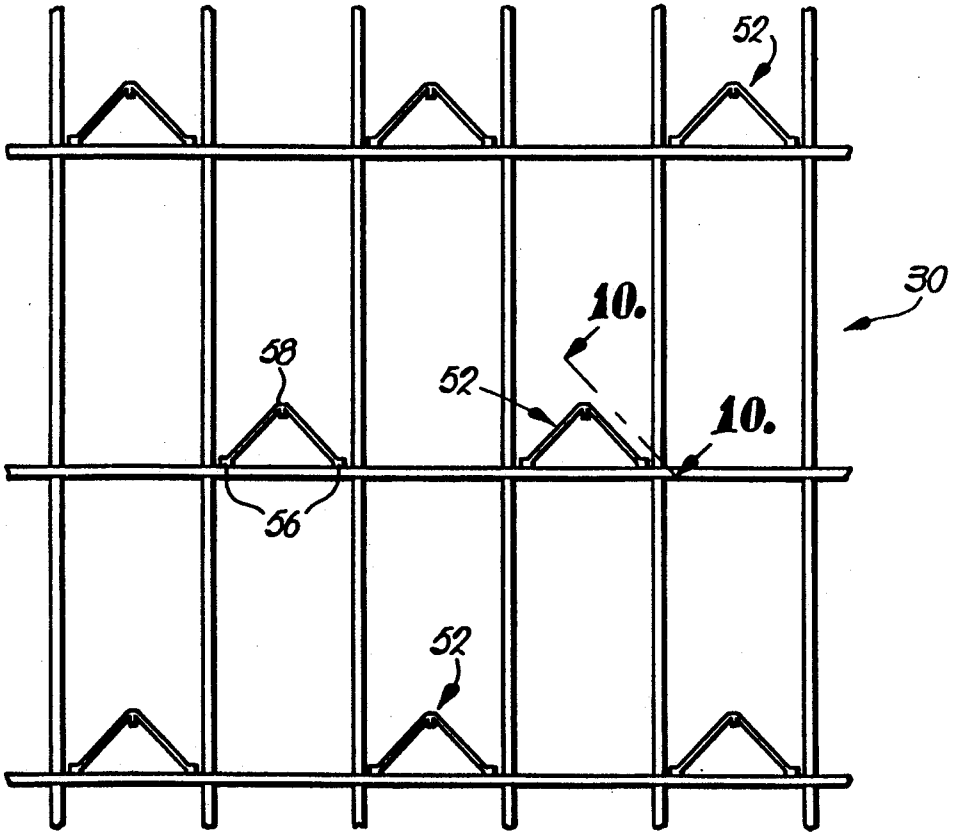
Fig. 9. PRIOR ART
FIG. 9 is an elevational view similar to that of FIG. 6, but depicting a fill assembly made up of the conventional inverted V-type splash bars.

FIGS. 9 and 10 illustrate the use of commercially available V-1 fill bars of the type described in the aforementioned DeFlon U.S. Pat. No. 3,389,895. In particular, these figures depict the use of the upright grid assembly 30 together with a plurality of triangularly-shaped V-1 fill bars 52 supported in the manner identical to that of FIG. 2, i.e., with the longitudinal axes of the fill bars being transverse to the direction of incoming cooling air currents (see FIG. 8). A detailed fragmentary view of one of the fill bars 52 is illustrated in FIG. 10, where it will be seen that the bars are provided with a plurality of diamond-shaped openings 54 through each diverging sidewall thereof, together with lower marginal feet 56, and a central uppermost apex section 58. As indicated previously, the net effective open area presented by these prior art bars is substantially greater than those of the present invention, and this would normally lead one skilled in the art to conclude that these prior art bars were more efficient.

Figure 12:
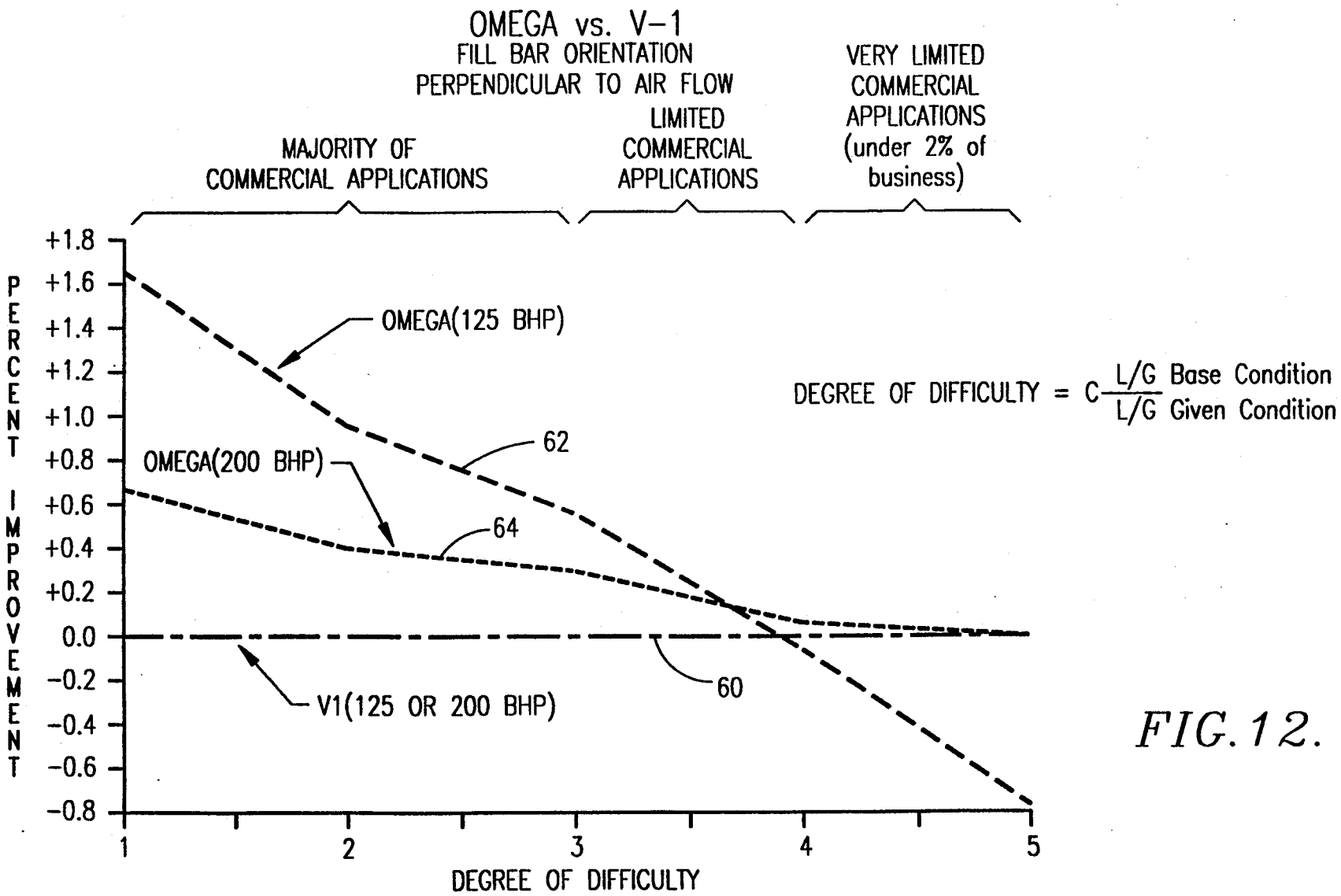
FIG. 12 is a graph depicting the results of a series of comparative test wherein the splash bars of the present invention were compared with the inverted V-type splash bars illustrated in FIGS. 8–11, with all bars being oriented transverse to incoming cooling air currents.
Figure 13:
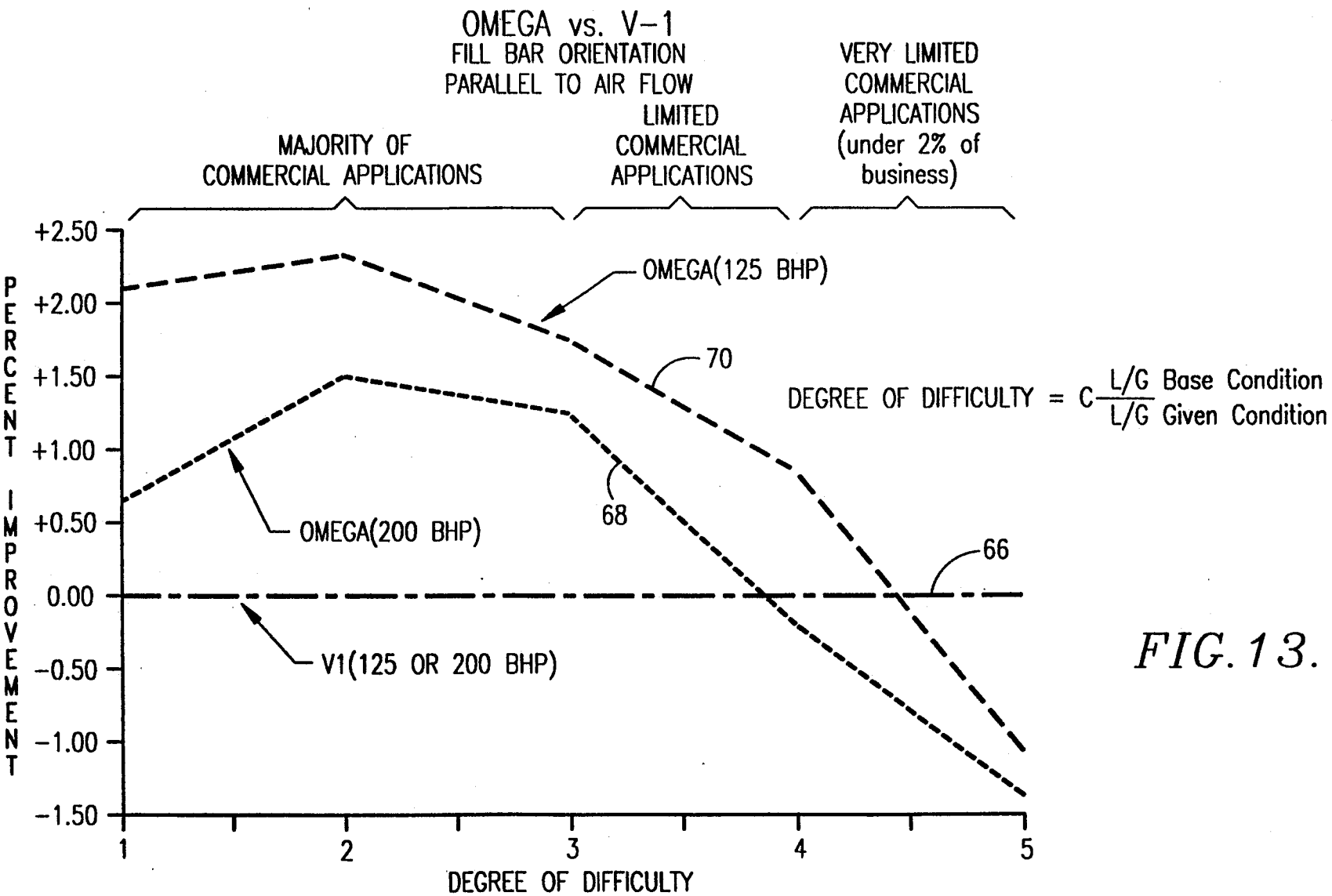
FIG. 13 is another graph similar to that of FIG. 12 and illustrating results of a series of comparative tests undertaken to determine the performance of splash bars in accordance with the present invention, versus inverted V-type bars, wherein all bars are oriented parallel to incoming cooling air currents.

Attention is next directed to FIGS. 12 and 13, which are graphical representations of directly comparative tests undertaken to determine the relative efficiencies of the bars of the present invention (referred to as "Omega" bars) versus the prior art V-1 inverted triangular in cross-section bars. In each instance, the results are set forth as plots of "Degree of Difficulty" versus "Percent Improvement". In this connection, and as shown in the figures, the "Degree of Difficulty" is equal to an arbitrary scaling constant C times the ratio of L/G for a base condition divided by L/G for a given condition. In this regard, the base condition is an arbitrary hot water temperature, cold water temperature, and wet bulb temperature which are held constant for purposes of comparing varying sets of conditions. The given condition on the other hand, is an arbitrary hot water temperature, cold water temperature, and wet bulb temperature different than the base condition temperatures. The factor L/G at the base condition is therefore the liquid (water) to gas (air) mass ratio required of the fill assembly to perform at the base condition. Finally, the factor L/G at the given condition is the liquid (water) to gas (air) mass required of the fill to perform at the given condition.

With particular reference to FIG. 12, which gives the comparative results in crossflow tower situation wherein the fill bars are perpendicular to air flow, it will be seen that the performance of the V-1 fill bars is illustrated by means of a horizontal line 60 represented as a base 0.0, for both 125 and 200 fan horsepower conditions. On the other hand, fill bars of the present invention are shown by the plots 62 and 64 for the two fan horsepower ratings. It will be seen that the fill bars of the present invention give measurably improved cooling performance, as compared with the V-1 bars, during essentially all of the significant commercial applications. That is to say, the vast majority of commercial applications occur with degrees of difficulty ranging from 1 to about 4, and in this important region, the bars of the present invention give improved results, as compared with the conventional V-1 bars. In the small number of applications (under 2% of towers) having degrees of difficulty of between 4 and 5, the fill bars of the present invention show decreased performance, and, in the case of the 125 horsepower fan rating, have a performance less than the V-1 bars. However, it will be appreciated that for virtually all normally encountered commercial situations, the bars of the present invention are superior.

In this connection, it should be understood that seemingly small percentage improvements in fill performance are significant when considered in the context of large commercial towers. That is to say, when dealing with millions of gallon of incoming hot water over a given period of time, the ability to achieve lower outgoing cool water temperatures at essentially no increase in cost represents a real boon to cooling tower users such as electric utilities. In the case of an electrical utility, it would have to devote less of its power output to run cooling fans in order to achieve a desired cooling effect, and thereby would have proportionally greater electricity to offer for sale to its customers.

FIG. 13 is very similar to FIG. 12, but depicts directly comparative tests wherein the respective fill bars are oriented in a crossflow tower context parallel to incoming air flow. Specifically, the performance of the V-1 bars is plotted as a horizontal line 66, again represented as a base 0.0, whereas the Omega bar performance is given as plots 68 and 70 for the 200 and 125 fan horsepower ratings respectively. Again, it will be seen that, at virtually all commercially encountered degrees of difficulty, the base of the present invention are superior to those of the prior art.

Figure 7:
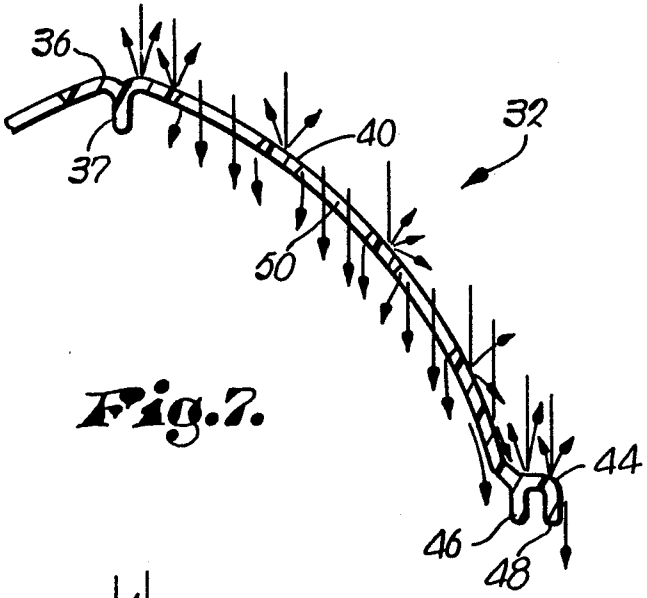
FIG. 7 is an enlarged fragmentary vertical sectional view illustrating the water droplet formation action of a splash bar in accordance with the present invention.
Figure 11:
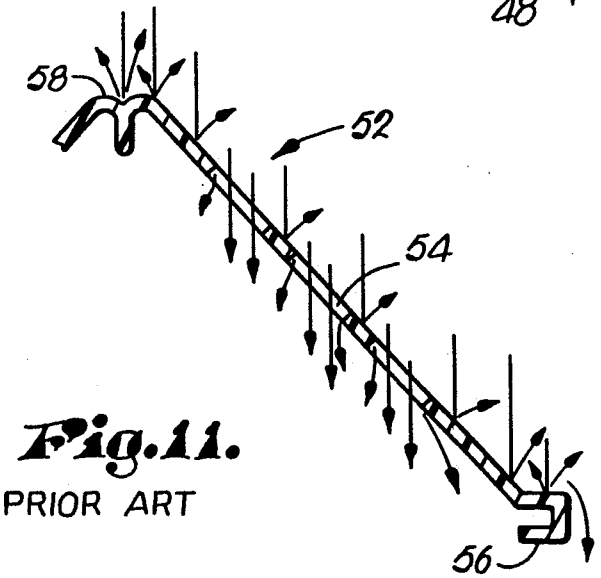
Fig.11. PRIOR ART
FIG. 11 is a greatly enlarged, fragmentary vertical sectional view similar to that of FIG. 7, but depicting the droplet formation action of the prior art splash bars.
Figure 6:
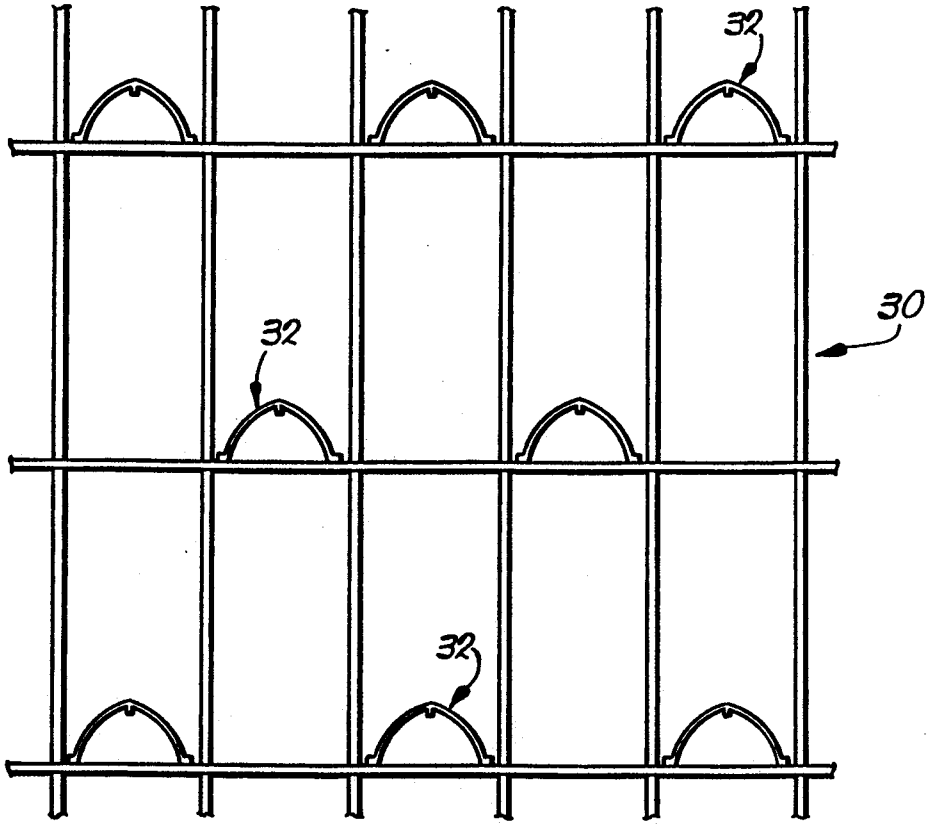
FIG. 6 is an end elevational view of a portion of fill structure, with the splash bars of the present invention being supported on the fill grid.

It is believed that the improved performance of the splash bars of the present invention stems in large measure from the water dispersal characteristics. Referring specifically to comparative FIGS. 7 and 11, such dispersal characteristics are schematically illustrated for the bars 32 of the present invention, versus the conventional V-1 bars 52 of the prior art. In the case of the bars 32, descending hot water striking the arcuate uppermost surfaces of the sidewalls 38 and 40 tends to disperse into plural small droplets, with the result that cooling efficiency is increased. This is to be compared with similar descending hot water striking the constant angle planar surfaces of the prior art fill bar, when a lesser degree of droplet formation occurs. At the same time, the strategic orientation of the apertures 50 in the bars of the present invention allow passage of water droplets into the central region of the respective bars, so as to achieve the maximum cooling effect both outside of and within the confines of the bars.

I claim:

1. A splash-type fill bar for evaporative water cooling towers and comprising:

an elongated body presenting an uppermost, fore and aft extending apex section and a pair of downwardly and outwardly diverging sidewalls extending from said apex section and each defining, at the lowermost ends thereof, a pair of elongated, laterally spaced apart feet for said body, each of said sidewalls being arcuate in cross-section and having a series of apertures therethrough, the vertical height of said body, when resting on said feet, being greater than one-half the lateral distance between the adjacent opposed inner surfaces of said feet.

2. The fill bar of claim 1, said apex section being imperforate.

3. The fill bar of claim 1, said apex section including an elongated, downwardly extending short central rib located between said sidewalls.

4. The fill bar of claim 1, said sidewalls being essentially mirror images of each other.

5. The fill bar of claim 1, each of said sidewalls defining a sector of an imaginary circle, with the centers of said imaginary circles being spaced from each other.

6. The fill bar of claim 1, said body being integral and formed of synthetic resin material.

7. The fill bar of claim 1, each of said sidewalls having a series of generally circular openings therethrough.

8. The fill bar of claim 1, adjacent apertures along the length of said sidewalls being vertically spaced from each other whereby the apertures assume a staggered configuration.

9. The fill bar of claim 1, said apertures being sized and located to give said body from about 20 to 40% net open area therethrough.

10. The fill bar of claim 1, each of said feet including a pair of short, slightly spaced apart, fore and aft extending base walls.

* * * * *